United States Patent [19]

Stevens, deceased

[11] 4,037,797

[45] July 26, 1977

[54] GRINDING MILL

[75] Inventor: Harold E. Stevens, deceased, late of Brigham City, Utah, by Joan Stevens, heiress

[73] Assignee: Mill & Mix Company, Inc., Brigham City, Utah

[21] Appl. No.: 464,794

[22] Filed: Apr. 29, 1974

[51] Int. Cl.[2] ..... B02C 7/14; B02C 7/18

[52] U.S. Cl. ..... 241/100; 241/248; 241/259.1; 241/261.2

[58] Field of Search ..... 241/37, 100, 248, 259.1, 241/259.3, 261.2, 296

[56] References Cited

U.S. PATENT DOCUMENTS

| | | | |
|---|---|---|---|
| 1,705,996 | 3/1929 | Pope | 241/259.1 X |
| 3,038,673 | 6/1962 | Fisher | 241/259.1 X |
| 3,076,487 | 2/1963 | Illsley | 241/248 X |
| 3,302,893 | 2/1967 | Feder et al. | 241/37 |
| 3,589,626 | 6/1971 | Saurer | 241/100 |
| 3,638,871 | 2/1972 | Barger | 241/296 X |
| 3,688,996 | 9/1972 | Kuest | 241/259.1 X |
| 3,750,966 | 8/1973 | Anderson | 241/100 X |
| 3,880,367 | 4/1975 | Grover | 241/296 X |

*Primary Examiner*—Lake, Roy
*Assistant Examiner*—Howard N. Goldberg
*Attorney, Agent, or Firm*—B. Deon Criddle

[57] ABSTRACT

A grinding mill arranged in a housing having a stone grinding wheel turned by a power source such that a face thereof moves over a fixed grinding stone. Grain deposited between faces thereof is ground into meal or flour and falls into a receptacle preferably in the housing that can be removed therefrom. The invention provides a feed arrangement for passing whole grain from a trough, through an opening in the fixed grinding stone to a location between the faces.

Adjustment of spacing between the faces of the stone grinding wheel and fixed grinding stone is provided by the inclusion of a manually turnable shaft arrangement that attaches to a threaded sleeve fixed to the electric motor. The turning of the shaft draws the electric motor toward or urges it away from a fixed point to shift the electric motor within the housing, so as to vary, as desired, the spacing between the faces.

4 Claims, 5 Drawing Figures

FIG. 2.
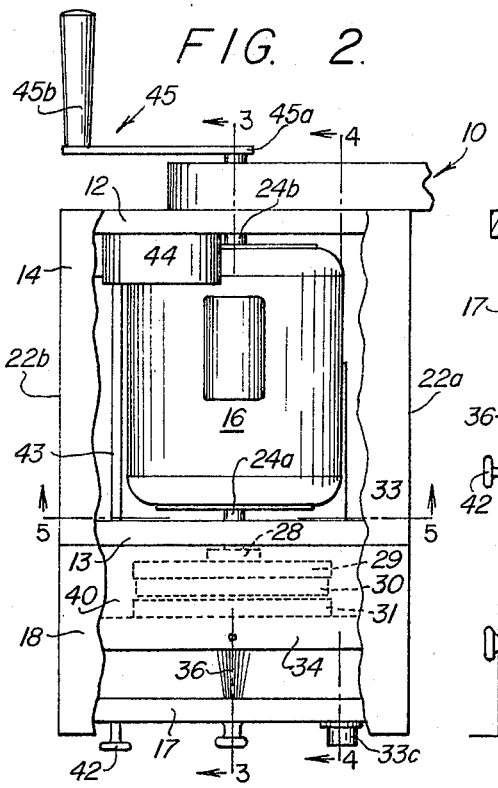
FIG. 3.
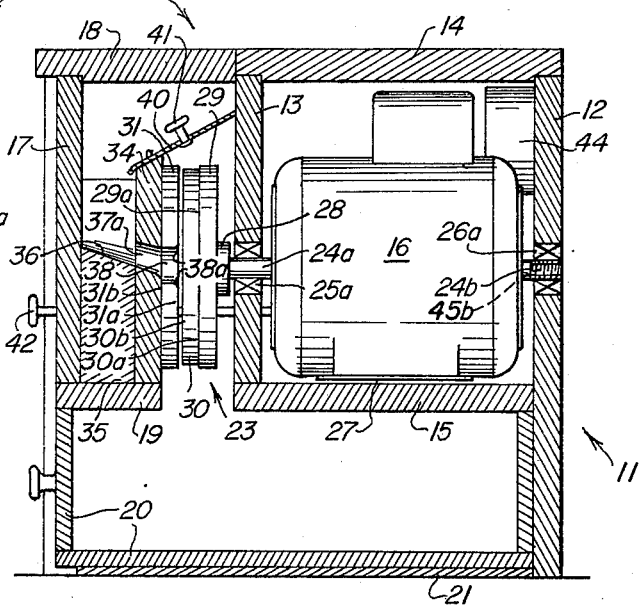
FIG. 4.
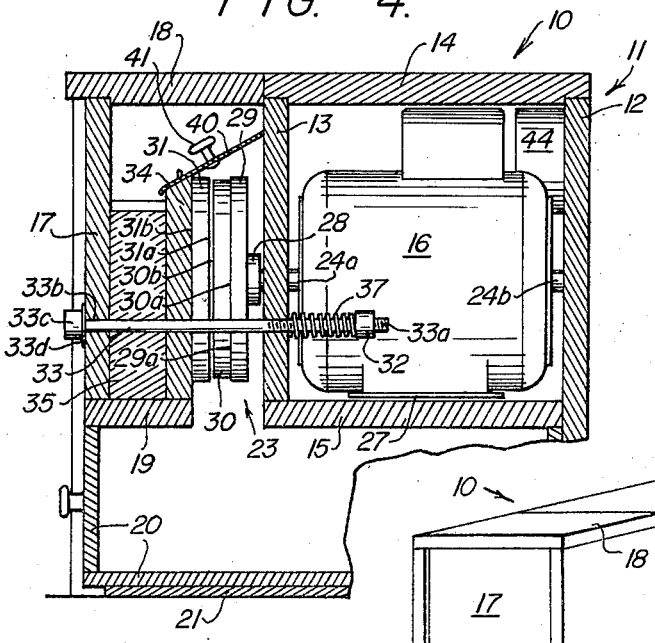
FIG. 5.
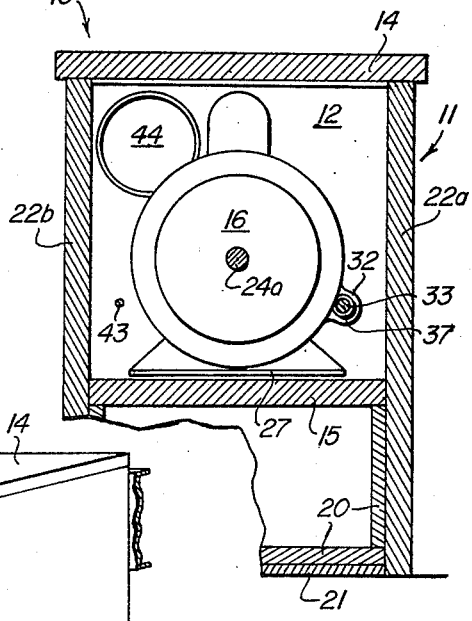
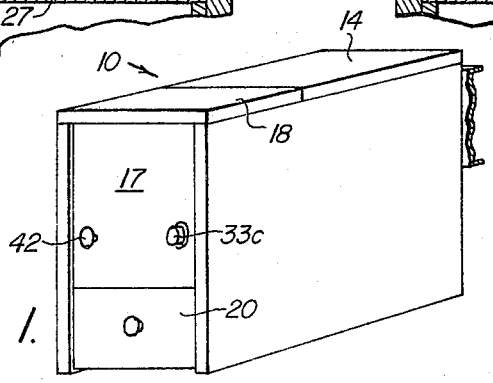
FIG. 1.

GRINDING MILL

BRIEF DESCRIPTION OF THE INVENTION

1. Field of the Invention

This invention relates to mills for grinding grain between faces of, respectively, turned and fixed grinding stones and incorporates means for adjusting, as desired, spacing between the faces of said stones.

2. Prior Art

Grinding devices utilizing fixed and turned grinding disks or stones are not new. Some such devices are shown in early U.S. Pat. Nos. 365,022, 425,817, 473,994, 628,314, 636,124, 932,822, 953,151, 102,588, and 1,485,855. Most of the above listed patented grinding devices employ some arrangement for controlling spacing between fixed and turning grinding portions thereof, with U.S. Pat. Nos. 365,022, 425,817, 636,124, 1,300,503, and 1,485,855 each employing clamping arrangements for binding together grinding portions thereof. U.S. Pat. Nos. 628,314, 932,882 and 953,151 employ means on a drive or turning shaft portion thereof for drawing a turning grinding disk or stone portion against a fixed grinding portion. Such adjustment means however, unlike the present invention that simultaneously moves the power source, connected shaft and stone grinding wheel to effect spacing, employ means for shortening or lengthening the effective length of the driver shaft and connected grinding disk rather than moving the connector power source and drive shaft.

Certain more recent United States patents, similar to the cited earlier prior art, also involve mechanical arrangements for shortening or lengthening the combined effective length of a drive shaft and connected grinding disk. Some such arrangements are shown in U.S. Pat. Nos. 1,346,277, 2,051,716, 3,488,008, 3,638,871 and 3,688,996. Distinct from these devices, the present invention by moving the power source, armature shaft and connected grinding wheel thereof, provides a simple and inexpensive yet reliable means for adjusting spacing between faces of a stone grinding wheel connected thereto and a fixed grinding stone.

Additional to the novel means employed by the present invention to effect spacing between grinder portions thereof, the present invention also employs a feed arrangement for depositing grain between the faces of, respectively, a stone grinding wheel and fixed grinding stone. The feed arrangement of the present invention involves a hole formed through the fixed grinding stone and a trough connecting thereto, through which trough and hole grain is intended to gravity feed to the grinder portion faces.

SUMMARY OF THE INVENTION

It is a principal object of the present invention to provide a grinding mill incorporating as grain grinding elements thereof a fixed grinding stone and stone grinding wheel, which stone grinding wheel is secured to a shaft that is turned preferably by an electric motor, the electric motor, shaft and connected stone grinding wheel being arranged to be movable to permit the adjustment of spacing between the faces of the stone grinding wheel and fixed grinding stone.

Another object is to provide a grinding mill contained within a housing, incorporating simple and essentially maintenance free components wherein grain can be ground to meal or flour and collected for processing into bread, cereal or the like.

Still another object is to provide a grinding mill constructed from inexpensive components that can be easily and efficiently constructed.

Principal features of the present invention include a housing containing a power source, preferably an electric motor, and having top panels thereof that are removable to allow access to the housing interior. An exhaust fan preferably is provided to remove heat and dust from the housing interior.

The electric motor arranged within the housing has its armature shaft ends each projecting through, respectively, apertures in a rear housing wall and in a divider wall. Bearings, such as ball bearings or the like, are disposed respectively in the wall apertures and support the shaft on either side of the motor, so that the motor is free-floating with respect to the motor base. The electric motor can thereby be moved horizontally within the housing with the respective armature shaft ends sliding freely on the bearings in the housing rear and divider walls. In this manner, minute incremental adjustments of the position of the electric motor within the housing can be made.

Means for controlling the reciprocal movement of the electric motor within the housing include preferably a sleeve secured to said electric motor threaded internally to accommodate a threaded end of a rod turned therein. The opposite end of the rod preferably is fitted through an appropriate opening in a front panel of the housing and has means for rotating the rod by an operator. By appropriately rotating the rod in one direction or the other, the electric motor is moved reciprocally within the housing, displacing therewith the end of the armature shaft that extends through the housing divider wall.

The armature shaft end that is fitted through the housing divider wall has a collar arranged thereon, which collar, in turn, connects to a mid point of a stone grinding wheel preferably formed as a disk. Therefore, when the electric motor is moved as described above, a front face opposite to said collar of that stone grinding wheel will be moved back and forth normal to the direction of travel of the electric motor. Arranged also in the housing is a fixed grinding stone, a smooth flat face thereof being positioned across from the stone grinding wheel, faces of each extending parallel to one another. Therefore, when the stone grinding wheel and electric motor are moved, as described above, the respective faces are moved towards or away from one another adjusting, thereby, spacing between said faces to accommodate different sizes and types of grain therebetween.

A grain deposit or catchment area is provided within the housing, between the inner surface of the housing front wall and face of the housing lateral wall, along side the stone grinding wheel. The catchment area has a removable divider plate arranged therein, above the respective stone grinding wheel and fixed grinding stone. The catchment area is formed with a downward slope turning in a sloping trough that feeds into a hole formed through the fixed grinding stone, grain traveling under the urging of gravity therethrough to inbetween the faces of said fix grinding stone and stone grinding wheel whereat it is ground to flour or meal by turning of the stone grinding wheel.

The flour or meal produced by the turning of the stone grinding wheel over the fixed grinding stone falls therefrom into a drawer arranged to be movable in and out of said housing. Such collected meal or flour can then be poured from that drawer into a mixer or the like.

Further objects and features of the invention will become apparent from the following detailed description, taken together with the accompanying drawings.

THE DRAWINGS

FIG. 1, a profile perspective view of a housing containing the components of the grinding mill of the present invention;

FIG. 2 is a top plan view of the grinding mill of FIG. 1; the top of housing thereof shown as being broken away to expose the interior thereof;

FIG. 3, a profile sectional view taken along the line 3—3 of FIG. 2, exposing the housing interior and the components contained therein;

FIG. 4, a profile sectional view taken along the line 4—4 of FIG. 2; and FIG. 5, a frontal sectional view taken along the line 5—5 of FIG. 2.

DETAILED DESCRIPTION

Referring now to the drawings:

Shown in FIG. 1, the present invention in a grinding mill 10 is preferably contained within a box shaped housing 11. In FIGS. 3 and 4 sectional views are shown of a top plan view of FIG. 2, which sectional views expose the housing 11 interior as consisting of an electric motor cabinet formed between a rear housing wall 12 and a divider wall 13 and below a top removable panel 14, showing therein an electric motor 16 disposed above intermediate a floor panel 15 in the housing. Shown also therein, housing 11 has a grinding chamber formed between the divider wall 13 and a housing front wall 17, below a top access panel 18, with a floor panel 19 arranged on line with the intermediate floor panel 15. A drawer 20, shown in FIGS. 3 through 5, is arranged below the floor panel 19 and intermediate floor panel 15, resting on a bottom panel 21 of the housing 11 that connects, along the edges thereof, to the rear housing wall 12 and housing side walls **22*a* and 22*b***.

The drawer 20, described above, is intended to slide freely in and out of the housing 11, and align when installed therein, below a grinder portion 23 of the invention, which grinder portion will be described in detail later herein. So arranged, when grain is ground in the grinder portion 23, it falls therefrom as flour or meal into the drawer 20, which drawer can then be removed and the collected flour or metal pour into a mixer or the like for further processing.

In FIG. 2, the center portions of the top removable panel 14 and top access panel 18 are shown broken away to expose the interior of the housing 11. Shown therein, and, as revealed in FIGS. 3 and 4, the electric motor 16 is aligned between the rear housing wall 12 and divider wall 13. The respective forward and rear ends **24*a* and 24*b* of an armature shaft of the electric motor 16 are shown fitted through and supported by bearings 25*a* and 26*a* respectively disposed in apertures 25 and 26 in the respective divider wall 13 and rear housing wall 12. Electric motor 16 is thereby maintained in alignment within the housing 11 between apertures 25 and 26 and is arranged to have the conventional motor mounting base plate 27 freely floating above floor panel 15. The armature shaft ends 24*a* and 24*b* thereby slide longitudinally when the electric motor is so moved in bearings 25*a* and 26*a*, maintaining the electric motor in longitudinal alignment within the housing 11. Bearings 25*a* and 26*a* also permit rotational motion of shaft 24** when the motor is operational to rotate the grinding face.

The forward portion of the armature shaft end **24*a* fits through bearing 25*a* in the divider wall 13, and has a collar 28 secured across the end thereof. The collar 28 is, in turn, secured to a mid point of a backing plate 29 whose forward face 29*a* is secured to a rear face 30*a* of a stone grinding wheel 30 that is preferably arranged to have rear and front faces 30 and 30*b* that are essentially parallel to one another. The stone grinding wheel 30 is, of course, a component of the grinder portion 23, which stone grinding wheel is turned by the electric motor 16 such that a front face 30*b* thereof turns with respect to a face 31*a* of a fixed grinding stone 31 that is a another component of the grinder portion 23 that is also preferably a disk having parallel front and rear faces 31*a* and 31*b* respectively. Grain positioned between the respective faces 30*b* and 31*a* will be broken apart into flour or meal by the action of the faces of the stone grinding wheel 30** turning over the opposite face of the fixed grinding stone.

Positioning of the faces relative to one another is accomplished by moving the electric motor, as described above, within the housing 11, the electric motor shaft 24 sliding through bearings **25*a* and 26*a*, until the proper or desired spacing between the face 30*b* of the stone grinding wheel 30 and the face 31*a* of the fixed grinding stone 31** is obtained.

To accomplish the above described sliding movement of the electric motor 16, to adjust spacing of the grinder portion 23, an internally threaded sleeve 32, FIG. 4, is secured to the side of the electric motor, extending longitudinally thereon and having a threaded end **33*a* of a rod 33 turned therein. The rod 33, extends therefrom and through the divider wall 13, a fixed grinding stone mounting wall 34, trough wall 35, and through the housing front wall 17 having a disk 33*d* arranged across the rod 33 at its point of exit from the front wall bracing against but not secured to that front wall, the rod 33 terminating in a knob 33*c* at rod end 33*b*. The knob 33*c* is, of course, intended to be manually turned so as to screw the rod end 33*a* into or out of the threaded sleeve 33, moving thereby the electric motor so as to close or open the gap between the stone grinding wheel and fixed grinding stone. A coil spring 37, FIG. 4, is preferably provided around the rod 33. The spring 37 is arranged such that the ends thereof contact the divider wall 13 and end of the threaded sleeve 32 to aid in moving the electric motor 16 away from the divider wall 13 when the knob 33c is turned out of the sleeve, with the disk 33d bracing against the housing front wall 17** when the rod is turned into the sleeve to draw the electric motor towards the divider wall.

As mentioned above, the back **31*b* of the fixed grinding stone 31 is secured at a face thereof to a fixed grinding stone mounting wall 34 that is, in turn, secured at a face thereof to the trough wall 35 that is secured at its opposite face to the inner surface of the housing front wall 17, with the edge of the trough wall, and fixed grinding stone mounting wall standing upon the floor panel 19. So arranged, as shown best in FIGS. 2 and 3, a trough 36 is provided in the top at the trough wall 35 at approximately the center thereof extending thereacross and, as shown in FIG. 3, the trough 36, shown in FIG. 3, slants downwardly such that grain deposited therein will gravity feed down the trough and into a downwardly slanting hole 37 turned through the fixed grinding stone mounting wall 34 and into and through a hole 38 into and through the fixed grinding stone 31. The hole 38, shown in FIG. 3, at its intersection with the face 31***a* of the fixed grinding stone 31, is flared outwardly at 38*a.* This flared arrangement is intended to encourage grain passing therethrough to travel from the hole 38, past the flared portion 38a thereof, to intersect and thereafter to be moved by the turning surface 30b of the stone grinding wheel 30. The individual grains are drawn thereby from the hole 38 to between the fixed grinding stone and stone grinding wheel. Thereat, the grain is broken up into flour or metal by the action of the face of one stone turning over the other.

Grain, by first removing the top access panel 18, can be deposited in the trough 36 and that grain falls through the housing top against a cover 40 therein that, as shown in FIGS. 3 and 4, slants upwardly from the fixed grinding stone mounting wall 34, above the grinder portion 23. The cover 40 is intended to close off the grinder portion 23 and provides a slanted surface for directing grain falling thereon into the trough 36. A knob 41 is provided on the cover 40 to facilitate its installation and removal into and from within the housing 11.

Shown best in FIGS. 1 through 3, a knob 42 is arranged on the housing front wall 17, alongside the knob 32*c,* which knob 42 in FIG. 2 is shown to connect through a rod 43 that extends alongside the electric motor to a switch, so arranged, when the knob is turned or pulled appropriately, the switch, not shown, will be energized to supply electric power to the motor and to an exhaust fan 44, FIGS. 2 through 5. The exhaust fan 44 is intended to operate when the electric motor 16 is operated, receiving power also from the operation of the switch, not shown, to exhaust air from within the housing out through a vent, not shown, arranged in the rear housing wall 12.

As described, the electric motor is intended to turn, through its armature shaft end 24*a,* the stone grinding wheel 30. Should, during such turning, a foreign object, such as a stone or the like, become lodges between opposite faces 30*b* and 31*a* of the stone grinding wheel 30 and fixed grinding stone 31, then it may be necessary to turn the electric motor armature shaft rear end 24*b* opposite to its normal direction of rotation. FIG. 2 shows a crank 45 havng an end 45a thereof that can be installed into a threaded center hole shown at 45b in broken lines in FIG. 3 of that armature shaft rear end 24*b.* So arranged with the crank end 45*a* installed in the armature shaft rear end 24*b,* by turning manually a handle end 45*b* of the crank 45 an operator can turn backwards the stone grinding wheel 30 so as to dislodge foreign matter from the grinder portion 23.

In operation, grain, not shown, is fed into the grinding mill 10 by first lifting off the top access panel 18 from the housing 11. Thereafter, grain is poured into that portion of the housing 11 between the opposing inner walls of the divider wall 13 and housing front wall 17, that grain falling against cover 40 and on top of the trough wall 35. The trough wall receives grain falling thereon and sliding off of the cover 40 and is sloped to feed that grain into a downward slanting trough 36 that intersects with downwardly slanting holes 37 and 38 formed through, respectively, the fixed grinding stone mounting wall 34 and fixed grinding stone 31. Grain directed through the holes 37 and 38 passes outwardly therefrom through a flared portion 38*a* of the hole 38 and thereafter is picked up by the stone grinding wheel face 30*b* turning thereover. That grain thereafter is broken apart into meal or flour by the action of the face 30*b* of the stone grinding wheel 30 turning over the face 31*a* of the fixed grinding stone 31, that grain falling from the grinder portion 23, between the ends of the intermediate floor panel 15 and floor panel 19, into the drawer 20. When sufficient flour or meal has been collected in the drawer 20, the drawer can be removed from the housing 11 and the collected flour or meal poured therefrom into another vessel and the drawer reinstalled in the housing 11.

The stone grinding wheel is, of course, turned through the armature shaft forward end 24*a* by the electric motor, operation of which electric motor and an exhaust fan 44 is controlled by a knob 42 arranged on the housing front wall 17 connected to a switch, not shown.

To effect different consistencies of grinds of flour or meal it is necessary to have the capability of being able to adjust the spacing between the faces 30*b* and 30*a,* respectively, of the stone grinding wheel 30 and fixed grinding stone 31. Such adjustment is provided by the arrangement of shaft 24 of electric motor 16 resting respectively on bearings 25*a* and 26*a* which may be mounted elsewhere than in wall 12 and 13, if desired, such as on support posts (not shown) extending upwardly from base 15. So arranged, the electric motor can be moved towards or away from said walls and the armature shaft ends in the bearings to prevent canting of the electric motor and the moveable grinding face during such travel.

The means for controlling movement of the electric motor 16 within the housing 11, as described above, consists, preferably, of a sleeve 32 that is internally threaded and secured to the side of the electric motor 16, extending along the motor, such that an end thereof exactly faces the divider wall 13. So arranged, a rod is fitted through the housing front wall 17, trough wall 35, a fixed grinding stone mounting wall 34, and divider wall 13, and had a threaded end 33*a* turned into the sleeve 32. This rod 33 has a knob 33*c* attached to the end 33*b* thereof that extends through the housing front wall 17, that can be turned by an operator, not shown, to turn the rod end 33*a* threaded into or out of the threaded sleeve 32 to move the electric motor 16 backward or forward within the housing 11. A collar 33*d* is arranged around the rod 33, proximate to the knob 33*c* and in contact with the housing front wall 17 to brace against that wall when the rod end 33*a* is turned into the sleeve 32. A spring 37 is provided with the rod 33, the ends thereof resting, respectively, on the face of the divider wall 13 and against an end of the sleeve 32, for aiding in moving the electric motor away from the divider wall 13 when the rod 33 is turned appropriately. Appropriate manual turning by an operator, not shown, of the knob 33*c* effects thereby, desired fine spacing of the faces 30*b* and 31*a* of the stone grinding wheel 30 and fixed grinding stone 31, which is not otherwise attainable with conventional adjustment means on presently available mills.

Although a preferred embodiment of the invention has been herein described, it is to be understood that the present disclosure is made by way of example and that variations are possible without departing from the subject matter coming within the scope of the following claims, which subject matter should be regarded as embracing the invention.

What is claimed is:

1. A grinding mill comprising a housing;

first and second partitions in the housing dividing the housing into compartments;

a motor in a first one of said compartments, said motor having an output shaft extending through said first partition into an adjacent second one of said compartments;

a grinding stone in said second compartment and fixed to and rotatable with said output shaft and a second grinding stone in said second compartment, said second stone being fixed to said second partition and held against rotation relative to said first stone and in face-to-face grinding relationship therewith and said second grinding stone having a hole through the center thereof through which grain to be ground is fed between the stones;

a removable lid extending from the first partition generally downwardly over the second partition within the housing and into a third compartment of the housing whereby grain placed therein is directed into the third compartment;

a floor panel beneath the first and third compartments;

a drawer opening in the housing below the floor panel and the second compartment;

a drawer havng an open top slidable into said drawer housing, whereby said open top is beneath the second compartment to receive material ground between the grinding stones in said compartment;

a hole through the second partition, said hold interconnecting the third compartment and the hole through the second grinding stone;

an access panel in the housing above the second and third compartments, through which grain to be ground can be fed; and guide means above the drawer in the third compartment for directing grain placed therein through the hole through the second partition and the hole through the second grinding stone to be grounded between said stones before falling from the second compartment to the drawer.

2. A grinding mill as in claim 1, further including means for adjustably changing the spacing between the grinding stones.

3. A grinding mill as in claim 2, wherein the housing includes front and rear walls interconnected by a top and side walls; and the drawer extends through the front wall and the access panel forms part of the top.

4. A grinding mill as in claim 3, wherein the means for adjustably changing the spacing between the grinding stones includes a shaft extending into the housing through front wall thereof, a knob on the shaft, exteriorly of the front wall thereof, threads on the shaft interiorly of the housing and nut means threaded on the shift and secured to one of said grinding stones to be movable therewith.

* * * * *